US008535001B2

(12) United States Patent
Costaouec

(10) Patent No.: US 8,535,001 B2
(45) Date of Patent: Sep. 17, 2013

(54) FASTENING OF THE ROTOR OF A CENTRIFUGAL PUMP

(75) Inventor: Laurent Costaouec, Pamé sur Roc (FR)

(73) Assignee: Wilo AG, Dortmund (DE)

( * ) Notice: Subject to any disclaimer, the term of this patent is extended or adjusted under 35 U.S.C. 154(b) by 569 days.

(21) Appl. No.: 12/863,440

(22) PCT Filed: Jan. 19, 2009

(86) PCT No.: PCT/EP2009/000297

§ 371 (c)(1),
(2), (4) Date: Jul. 17, 2010

(87) PCT Pub. No.: WO2009/090099

PCT Pub. Date: Jul. 23, 2009

(65) Prior Publication Data

US 2011/0052402 A1 Mar. 3, 2011

(30) Foreign Application Priority Data

Jan. 19, 2008 (DE) ..... 10 2008 005 245

(51) Int. Cl.
*F04D 1/06* (2006.01)
*F04D 29/22* (2006.01)
*F04D 29/20* (2006.01)

(52) U.S. Cl.
USPC ..... 415/198.1; 415/199.1; 415/199.2; 415/199.6; 415/200

(58) Field of Classification Search
USPC ..... 415/198.1, 199.1, 199.2, 199.6, 200
See application file for complete search history.

(56) References Cited

U.S. PATENT DOCUMENTS

| | | | | | |
|---|---|---|---|---|---|
| 3,025,800 | A | * | 3/1962 | Hix et al. | 415/172.1 |
| 3,116,696 | A | * | 1/1964 | Deters | 415/140 |
| 3,265,001 | A | * | 8/1966 | Deters | 415/68 |
| 3,288,074 | A | * | 11/1966 | Hall | 415/199.3 |
| 3,477,384 | A | * | 11/1969 | Hlinka | 415/199.3 |
| 3,612,716 | A | * | 10/1971 | Deters | 415/140 |
| 3,837,612 | A | | 9/1974 | Deters | 249/105 |
| 5,176,021 | A | | 1/1993 | Jensen et al. | 72/348 |
| 6,168,376 | B1 | | 1/2001 | Wagner | 415/169.1 |
| 7,520,454 | B2 | | 4/2009 | Zelder et al. | 241/46.06 |

FOREIGN PATENT DOCUMENTS

| | | | |
|---|---|---|---|
| DE | 3939156 | C2 | 5/1991 |
| DE | 199 53 911 | A | 11/2000 |
| EP | 0 911 528 | A | 4/1999 |
| EP | 0 911 528 | B | 2/2003 |

* cited by examiner

*Primary Examiner* — Igor Kershteyn
(74) *Attorney, Agent, or Firm* — Milton Oliver, Esq.; Oliver Intellectual Property

(57) ABSTRACT

The invention relates to a rotor wheel constructed of sheet metal for a centrifugal pump, particularly a multi-stage centrifugal pump, with means for fastening to the drive shaft of an electric motor, wherein the rotor wheel has a central coaxial opening in which a sleeve is fastened coaxially, wherein the sleeve projects out of the rotor wheel on at least one side of the rotor wheel, and wherein the sleeve has, in its inner wall, projecting, axially parallel ridges for fastening into axially parallel notches or grooves of the motor drive shaft.

14 Claims, 2 Drawing Sheets

FASTENING OF THE ROTOR OF A CENTRIFUGAL PUMP

CROSS-REFERENCE TO RELATED APPLICATION(S)

This application is a section 371 of PCT/EP09/00297, filed 19 Jan. 2009, published 23 Jul. 2009 as WO 2009-090 099-A, and claims priority from DE 10 2008 005 245.0, filed 19 Jan. 2008, the entire content of which is hereby incorporated by reference.

FIELD OF THE INVENTION

The invention relates to a sheet-metal rotor wheel of a centrifugal pump with means for fastening onto the drive shaft of an electric motor.

BACKGROUND

A variety of different ways of fastening rotor wheels onto pumps are known. They require, typically, multiple parts, a difficult assembly process, and a substantial consumption of materials.

SUMMARY OF THE INVENTION

It is an object of the invention to provide a rotor wheel of the aforementioned type with fastening to the motor shaft which, despite simple construction and assembly, achieves an optimal transfer of power and an exact positioning of the rotor wheel.

In accordance with the invention, this object is achieved in that the rotor wheel has a central coaxial opening, into which a sleeve is coaxially secured, that the sleeve projects, at least on an impeller side, from the rotor wheel, and that the sleeve has, on its inner surface, axially parallel beads or ridges which engage into axially parallel slots or grooves of the motor drive shaft.

In such a structure, the sleeve serves both the function of power transfer and the setting of the exact position of the rotor wheel, and/or of the spacing distances of rotor wheels with respect to each other.

In this manner, high torques are transmissible to the rotor wheel, yet small consumption of material is achieved. Optimally, this structure is employed in making rotor wheels from sheet metal, which achieves a desirably low mass.

Further, one achieves an optimal oscillation behavior and a high compensation for tolerances. There is a structurally simple and secure fastening, requiring few parts, and one achieves simplicity in assembly, even when assembling two or more rotor wheels in a multi-stage pump.

A particularly simple structure, offering high torque transfer, is achieved when the ridges are formed by notching outward places in the sleeve wall. Further, it is advantageous when the axially parallel ridges are formed axially before a region of the sleeve which extends outward from the rotor wheel. It is suggested that the length of the ridges be 10% to 60% of the length of the sleeve.

In order to achieve simple and secure fastening of the sleeve into the rotor opening, it is suggested that an annular bulge or torus be provided on the sleeve outer wall. The annular bulge can be arranged in a central portion of the sleeve. Preferably, the sleeve is welded into place, in the central opening of the rotor wheel, by laser welding.

It is particularly advantageous to use a rotor wheel with such a sleeve in a multi-stage pump with multiple rotor wheels. The sleeves of the rotor wheels are arranged with their faces contacting each other, and the sleeve lengths determine the spacings of the rotor wheels from each other.

BRIEF FIGURE DESCRIPTION

Advantageous embodiments of the invention are shown in the drawings and described in greater detail below. Shown are:

DETAILED DESCRIPTION

Figure 1:
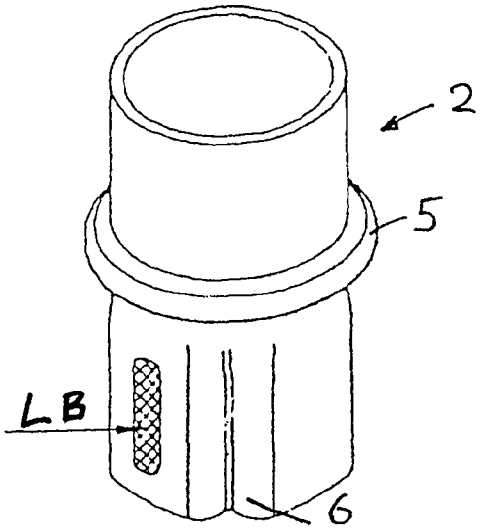
FIG. 1 is a perspective view of a first embodiment of the sleeve.
Figure 2:
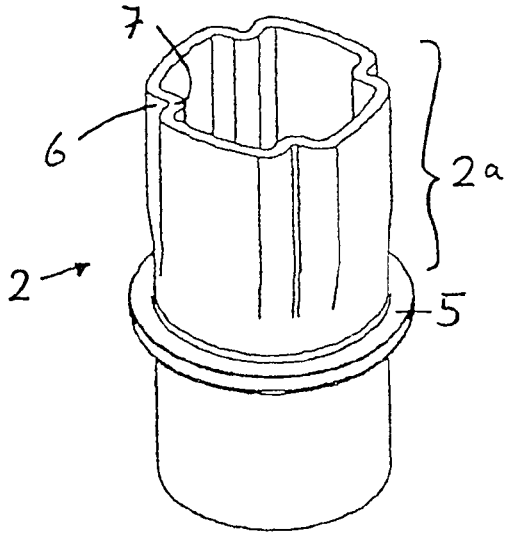
FIG. 2 shows the sleeve of FIG. 1 rotated onto its head.
Figure 3:
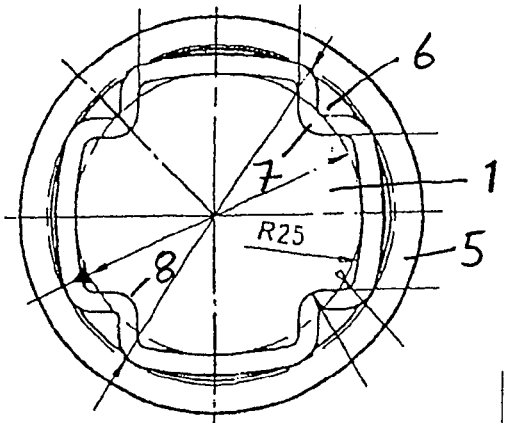
FIG. 3 is a cross-section of the sleeve placed inside a shaft.

A centrifugal pump rotor wheel made of sheet metal features a central coaxial opening, using which the rotor wheel is fastened onto the shaft 1 of an electric motor (not shown). For this purpose, a sleeve 2, formed from a pipe section, is provided. The sleeve is inserted into the opening 3 of rotor wheel 4. During this, the sleeve 2 is shoved so far into the rotor opening 3 that an annular coaxial bulge 5, extending outwardly from sleeve 2, rests against a rim of opening 3. This assures an exact positioning of sleeve 2 with respect to rotor wheel 4.

After reaching this secure position, the sleeve 2 is fastened to the rotor opening rim by laser welding using laser beam LB as shown in FIG. 1. The annular bulge 5 is made by upsetting deformation of the sidewall of sleeve 2.

In a region 2*a* of sleeve 2, which starts at an end of the sleeve and stops before the annular bulge 5, a plurality of axially parallel beads or ridges 7 are formed in the inner wall of sleeve 2. In the embodiment shown in the drawings, four axially parallel beads project on the inner surface of sleeve 2 at respective identical intervals of 90 degrees, the shaft 1 having, at the same four places, a respective notch or groove 8, into which the bead 7 form-lockingly engages, so that a secure form-lock between shaft 1 and sleeve 2 is created with the rotor 4.

When using this manner of fastening in a two- or more-stage pump, two or more sleeves 2 are mounted on the shaft with their faces contacting each other, so that the lengths L of the sleeves, especially the lengths of regions 2*a*, which at least partially project out of the rotor wheel, define the exact positions of the rotor wheels on the shaft, and with respect to each other.

Figure 4:
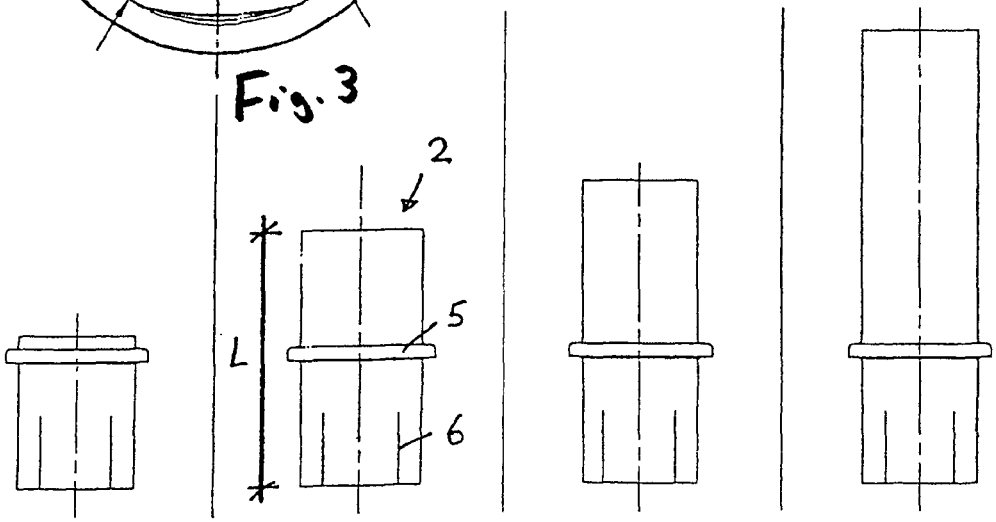
FIG. 4 shows four different embodiments of the sleeve, in varying lengths.
Figure 5:
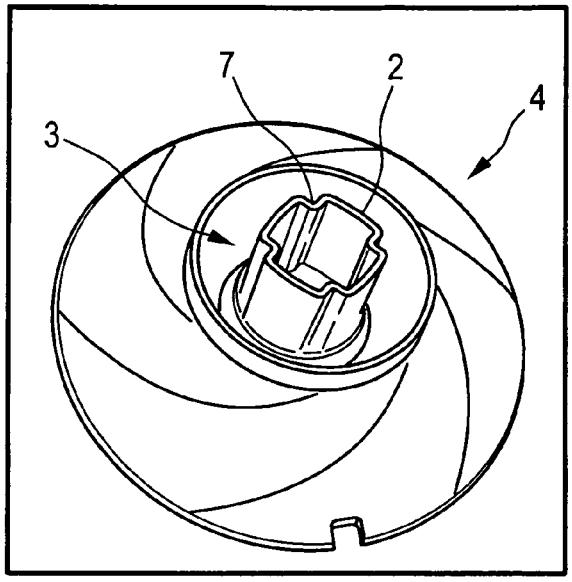
FIG. 5 is a view of the front side of a rotor wheel with a sleeve inserted into the rotor opening and extending therefrom, with inwardly extending ridges.
Figure 6:
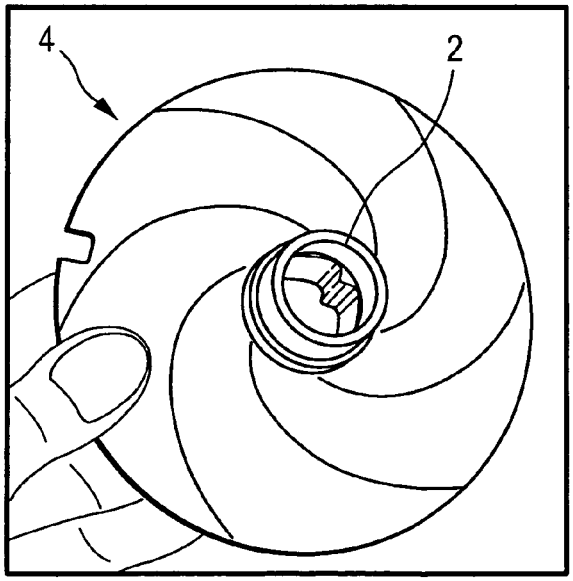
FIG. 6 is a view of the back side of the rotor wheel.

Depending upon the structure and function of the pumps and of the rotor wheels, sleeves 2 can be configured with differing lengths, as shown in FIG. 4.

What is claimed is:

1. A metallic rotor wheel (4) of a multi-stage centrifugal pump with means for fastening onto the drive shaft (1) of an electric motor, characterized in that the rotor wheel (4) is formed with a central coaxial opening (3) into which a sleeve is coaxially fastened;

the sleeve (2) projects outward, at least on an impeller side of the rotor wheel; and the sleeve (2) is formed, on an inner surface thereof, with a plurality of axially parallel ridges (7) for fastening into axially parallel notches or grooves (8) of the motor drive shaft (1).

2. A rotor wheel according to claim 1, characterized in that the ridges (7) are formed by punching notches outward from the sleeve sidewall.

3. A rotor wheel according to claim 1, characterized in that the axially parallel ridges are formed in a portion (2*a*) of the sleeve which projects outward from the rotor wheel.

4. A rotor wheel according to claim 1, characterized in that the lengths of the ridges (7) fall in the range from 10% to 60% of the length of the sleeve (2).

5. A rotor wheel according to claim 1, characterized in that a coaxial annular bulge (5) is formed on the exterior sidewall of the sleeve.

6. A rotor wheel according to claim 5, characterized in that the annular bulge (5) is formed in a middle portion of the sleeve (2).

7. A rotor wheel according to claim 1, characterized in that the sleeve (2) is connected to the central rotor wheel opening by a welded connection.

8. A multi-stage pump with a single motor drive shaft (1) and multiple rotor wheels secured thereto, wherein each rotor wheel (4) is formed with a central coaxial opening (3) into which a sleeve (2) is coaxially fastened;

the sleeve (2) projects outward, at least on an impeller side of the rotor wheel; and the sleeve (2) is formed, on an inner surface thereof, with a plurality of axially parallel notches or grooves (6) of the motor drive shaft (1); and wherein the sleeves (2) of the rotor wheels rest with their side faces against each other, the sleeve lengths thereby setting the respective spacings of the rotor wheels from each other.

9. A rotor wheel according to claim 2, characterized in that the axially parallel ridges are formed in a portion (2*a*) of the sleeve which projects outward from the rotor wheel.

10. A rotor wheel according to claim 2, characterized in that the lengths of the ridges (7) fall in the range from 10% to 60% of the length of the sleeve (2).

11. A rotor wheel according to claim 3, characterized in that the lengths of the ridges (7) fall in the range from 10% to 60% of the length of the sleeve (2).

12. A rotor wheel according to claim 2, characterized in that a coaxial annular bulge (5) is formed on the exterior sidewall of the sleeve.

13. A rotor wheel according to claim 3, characterized in that a coaxial annular bulge (5) is formed on the exterior sidewall of the sleeve.

14. A rotor wheel according to claim 4, characterized in that a coaxial annular bulge (5) is formed on the exterior sidewall of the sleeve.

* * * * *